United States Patent [19]

Ricca

[11] 4,141,658

[45] Feb. 27, 1979

[54] ATTACHMENT FOR REMOTE CONTROL OF A KEYBOARD

[76] Inventor: Tom L. Ricca, 1407 Wyandotte Rd., Columbus, Ohio 43212

[21] Appl. No.: 811,061

[22] Filed: Jun. 29, 1977

[51] Int. Cl.[2] ..... B41J 5/00

[52] U.S. Cl. ..... 400/70; 400/474

[58] Field of Search ..... 197/19, 20, 98; 235/145 R, 146

[56] References Cited

U.S. PATENT DOCUMENTS

| | | | |
|---|---|---|---|
| 761,179 | 5/1904 | Pilsatneeks | 197/19 |
| 1,753,991 | 4/1930 | Langford | 197/19 |
| 2,613,797 | 10/1952 | Hogg | 197/19 |
| 2,718,559 | 9/1955 | Lundkvist et al. | 335/112 |
| 2,741,669 | 4/1956 | Barrett | 200/1 R |
| 2,924,321 | 2/1960 | Ziskind et al. | 197/19 |
| 3,249,199 | 5/1966 | Jones | 197/19 |
| 3,255,318 | 6/1966 | McKee | 200/1 R |
| 3,340,985 | 9/1967 | Sinila | 197/19 |
| 3,713,054 | 1/1973 | Elliot | 335/112 |
| 3,863,044 | 1/1975 | McCormick | 200/175 |

FOREIGN PATENT DOCUMENTS

| | | | |
|---|---|---|---|
| 2325743 | 12/1974 | Fed. Rep. of Germany | 197/19 |

*Primary Examiner*—Paul T. Sewell

[57] ABSTRACT

An attachment for remote control of a keyboard cmprising a series of selecting elements mounted for movement in a first direction between inoperative and operative positions, each having a series of apertures; a series of push-bars mounted for movement in a second direction, each having an elongated member oriented longitudinally in a third direction; a plurality of push-sticks, each being rotatably linked at one of its ends to one of the elongated members of push-bars and slidably linked at its other end to an aperture of one of the selecting elements; devices for selectively moving the selecting elements and push-bars; a plurality of push-rods mounted for movement in the second direction, each having its lower tip suface bearing on top of the corresponding key, and its upper tip surface being acted upon by the corresponding push-stick in the direction that causes the corresponding key to move from inoperative position to operative position only when the selecting element linked to the push-stick was first moved to operative position and then the push-bar linked to the push-stick was next moved to operative position; whereby selectively moving the selecting elements and the push-sticks selectively moves the keys of the keyboard from inoperative position to operative position and actuates consequently the functions intended for the keys.

15 Claims, 7 Drawing Figures

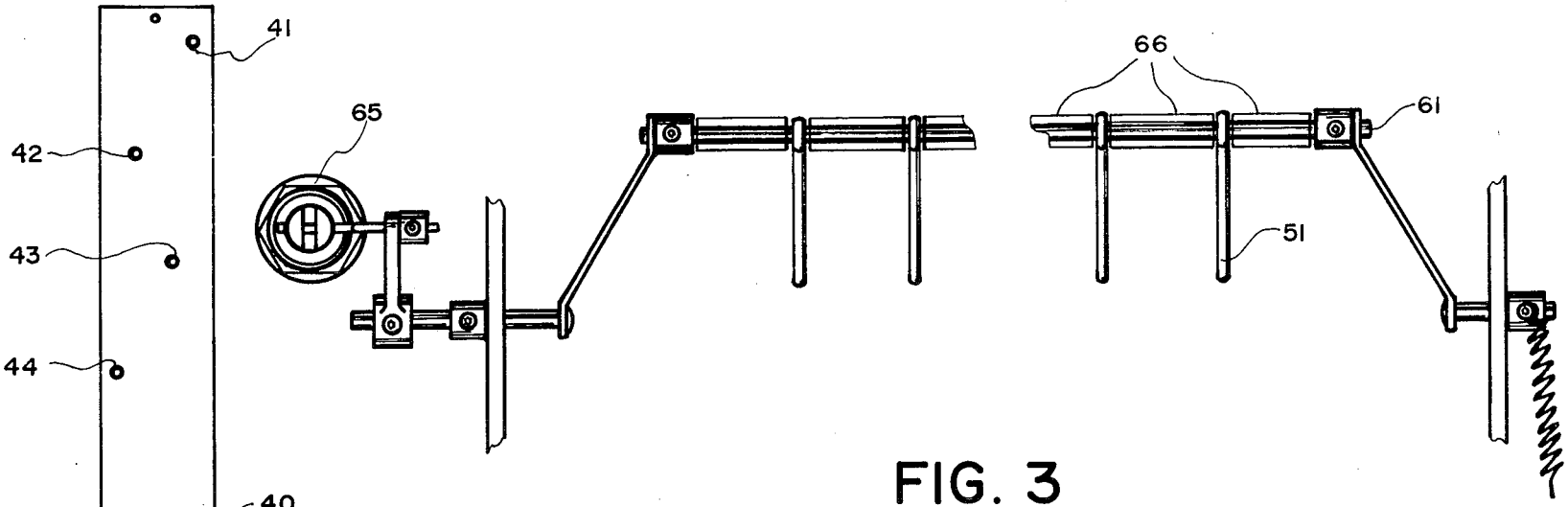
FIG. 3
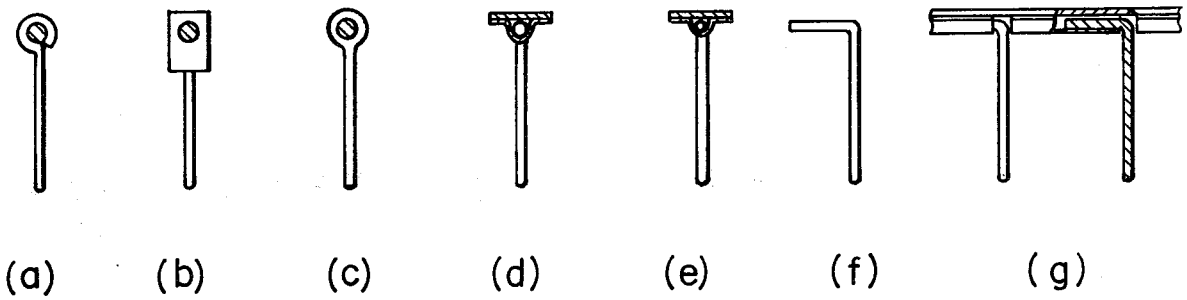
FIG. 4
FIG. 2

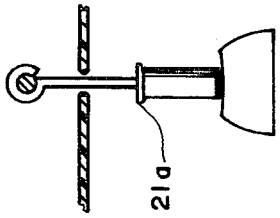
FIG. 6
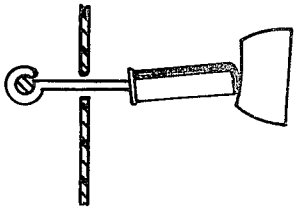
FIG. 7
FIG. 5
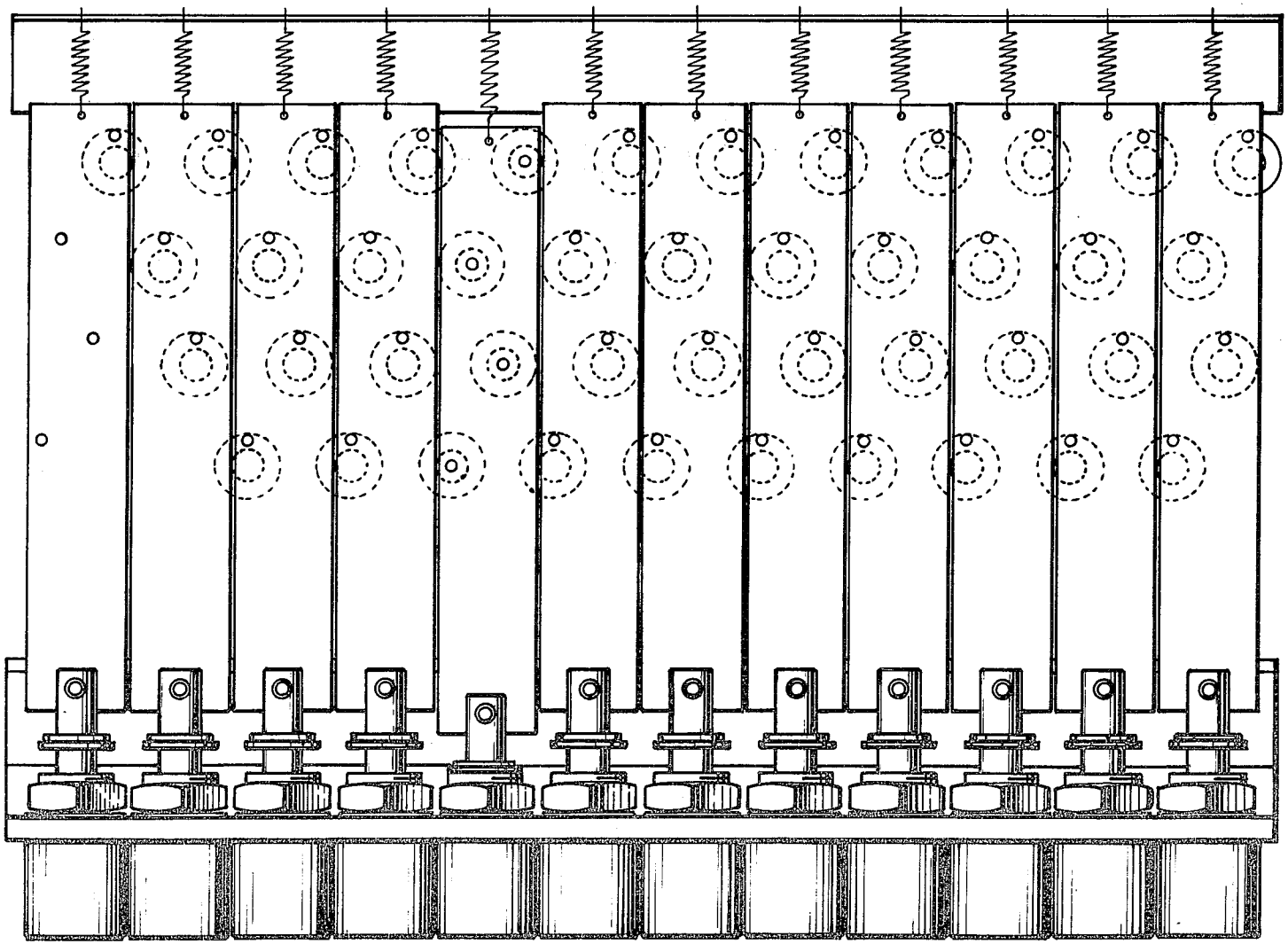

ATTACHMENT FOR REMOTE CONTROL OF A KEYBOARD

BACKGROUND OF THE INVENTION

This invention relates to an attachment for remote control of the keyboard of one of the general classes of keyboard-operated devices characterized by electric typewriters, fluidic typewriters, manual typewriters, type-setting machines and calculators.

The invention relates particularly to an attachment for remote control of a typewriter in which the excursion of the keyboard buttons or keys that trigger the printing mechanism is relatively short and actuatable with a relatively light force such as found presently on electric typewriters.

This attachment permits a quick and inexpensive adaptation of said typewriters for remote control via one of the standard sets of codes, such as the American Standard Codes for Interchange of Information, ASCII, with very little modification on the typewriters. Such remote control is desirable in computer output where the whole set of high-quality characters of upper and lower case of standard typewriters is needed, such as in word processing purpose. Using many high-quality typewriters already available in homes or offices, the invention provides, with substantial savings, high-quality computer hard-copy units for data- and word-processing systems suitable for home and office use. Along with these high-quality typewriters and electronic keyboards, the invention provides competitive heavy-duty input/output units for telecommunications where very high speed is not needed, between people and people, people and computers. Compared to popular units currently in use in telecommunications, the modular nature of the invention when attached to a typewriter and an electronic keyboard affords lower operational cost by allowing modular interchange or replacement of parts. When attached to an inexpensive electric typewriter, the invention provides readily a competitive light-duty printer for many users.

Another typical application for said remote control is the housing of the printing mechanism, which is noisy in general, in an openable silencing enclosure, and activating the code generating by an electronic keyboard, which is quiet in general, outside of said enclosure for the purpose of reducing the disturbing noise pollution in many present offices.

Such remote control can be used also for an invalid or a person who desires special typing comfort in which the printing unit rests on a stand somewhere around, and the keyboard for code generating, custom made if necessary, can be accommodated with fingers on said person's lap, or even with his feet if he can not use his hands and if the keys of said keyboard are made specially large.

The advantages of the invention consist in the relatively low cost in general applications and extreme ease in converting many types of ordinary typewriters for remote control with little or no modifications on said typewriters, so that they can be easily maintained, serviced or replaced by many regular typewriter service centers, and so that they can be reverted back for use in their original functions, by quickly and simply removing said attachment from said typewriter.

SUMMARY OF THE INVENTION

In order to aid the understanding and simplify the disclosure, the following description assumes the part of the keys of the keyboard normally designed originally for finger manipulation to be horizontal, and the direction from inoperative to operative positions of said keys to be vertically downward. The invention will work as well in other orientations.

The present invention is provided with means for positioning slidably on top of each key of the keyboard to be remotely controlled a corresponding push-rod, preferably of cylindrical shape, oriented preferably in the vertical direction longitudinally. Acting with a suitable vertical force downwards on top of each push-rod moves supposedly the key corresponding to said push-rod from inoperative position to operative position. Spring means for returning the keys back to inoperative position when said force is removed, is assumed to be provided with said keys. Corresponding to each push-rod is an elongated, preferably cylindrical push-stick linked rotatably at its upper end to one of the push-bars and linked slidably at its lower end to one of the apertures of one of the selecting elements. In the preferred embodiment, said selecting elements are mounted longitudinally for movement in one horizontal direction while the push-bars are mounted to move in a manner such that, in their movement, all the points linking said push-bars with said push-sticks follow essentially the corresponding verticals going through the axes of the corresponding push-rods. Each selecting element is mounted in a manner such that when moved to operative position, it orients longitudinally all the push-sticks linked slidably thereto on a vertical coinciding with the axes of the corresponding push-rods. In the contrary, when each selecting element is in inoperative position, all the push-sticks linked slidably thereto are oriented in a direction going through a zone clearly beyond the surface of the upper tip of the corresponding push-rods. The invention is further provided with suitable means for selectively moving said selecting elements and said push-bars between inoperative and operative positions, and means for limiting the movement of the push-rods within a suitable range. In the preferred embodiment, when the push-bars are in inoperative position the lower tips of all the push-sticks are essentially a same suitable distance above the upper tips of all the push-rods, which have different lengths if necessary, so that their upper tips will be on the same horizontal level and at the same time their lower tips will be in constant contact with the tops of the corresponding keys.

In operation of the preferred embodiment, decoded electric signals are used to first move a selecting element to operative position and then to move next a push-bar to operative position from the inoperative position. It can be seen then, only the particular push-stick linked both to thus actuated selecting element and push-bar can have an effect on the corresponding push-rod. The effect is to move said push-rod downward, and in turn, to move the corresponding key from inoperative position to operative position, and to actuate consequently the functions of said key.

The principal object of the invention is to provide an attachment generally applicable for remote control of a keyboard in which the keys are arrangeable in a matrix fashion of a first series of suitably aligned groups of keys defined as rows, and a second series of suitably aligned groups of keys defined as columns; each group of one series crossing one group of the other series at an angle preferably close to a right angle; and in which the direction of the keys between inoperative and operative positions in preferably close to a direction orthogonal to the directions of alignment of said rows and said columns. Although the invention applies best to situations wherein the rows and columns of keys of the keyboard are straight, it can accommodate also situations wherein the rows or the columns of keys or both are not in straight lines parallel to each other in each series, but such that said selecting elements and push-bars can be made to embrace the keys within strips not overlapping each other in their movement between inoperative and operative positions.

A further object of the invention is to provide an attachment for remote control of the keyboard of a regular typewriter, preferably electric, having an arrangement of keys following one of the standards universally adopted in typewriter manufacturing. If the lines of characters on a page being typed on said typewriter in normal use are taken as parallel to the rows of keys of said keyboard, the invention is seen to be applied here in a situation wherein the rows of keys are straight lines parallel to each other, and the columns of keys can be arranged so that the selecting elements embrace the keys in strips parallel to each other and not overlapping each other in their movement between inoperative and operative positions. Furthermore, in this preferred embodiment, the directions of rows and columns of keys are made orthogonal to each other, and in turn orthogonal to the direction of movement of the push-bars, chosen to be the same as that of said push-rods and keys of said keyboard.

A further object of the invention is to provide means for decoding a set of standard information-interchange codes into different signals for selectively moving said selecting elements and said push-bars and actuating some non-printing keys normally found on a typewriter.

A still further object of the invention is to provide means for quick put-on and removal of said attachment as applied to a typewriter.

Other objects and advantages of the invention will become better understood hereinafter from a consideration of the specification with reference to the accompanying drawings forming part thereof, and in which like numerals correspond to like parts throughout the several views of the invention.

BRIEF DESCRIPTION OF THE DRAWINGS

FIG. 2 shows the locations of the apertures on a selecting element.

FIG. 3 shows one way of implementing means for moving the push-bars.

FIG. 4 shows different ways of implementing means for rotatably linking the push-sticks to the push-bars.

FIG. 5 is a top view of said attachment as applied to a typewriter keyboard, with one of the selecting elements moved to operative position.

FIG. 6 is a view of a preferred situation wherein a push-stick drives the corresponding key to operative position when the related selecting element and push-bar have been moved into operative position; and FIG. 7 is a view of a general, but still applicable situation wherein the directions of movement of the push-bars, push-rods and keys are not the same but still close enough to each other.

DETAILED DESCRIPTION

Figure 1:
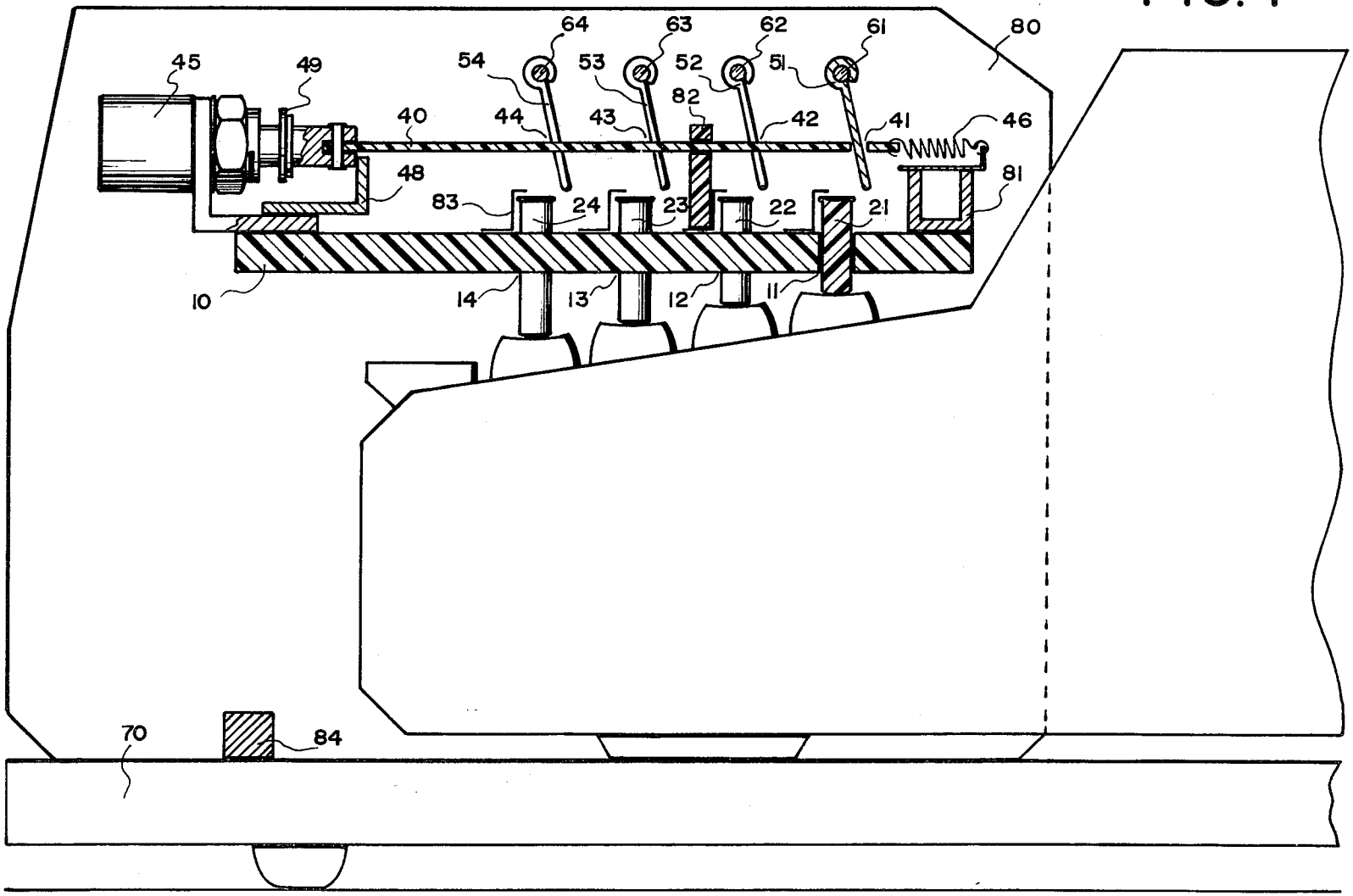
FIG. 1 shows a partially sectional, right-side view of the attachment characterizing the invention as applied to a typewriter keyboard.

In the following description, the details of an attachment characterizing the invention as applied to an electric typewriter are described first, and then the operations will be generalized to the invention as applied to a whole class of keyboards.

The typewriter on which the invention is to be attached is supposed to be secured onto a horizontal surface as if it were to be secured for use by a typist in a usual manner. It will be obvious, at the end of the description, that once the invention is attached onto said typewriter, the combination of said attachment and typewriter can work properly in any orientation imaginable, in the operations to be described, provided that said typewriter can tolerate such an orientation.

Referring to the drawing of FIG. 1, the attachment characterizing this invention as applied to a typewriter keyboard comprises a plate 10 of adequate thickness, and of low-friction, low-wear material, having a plurality of cylindrical apertures 11,12,13 and 14 to be positioned directly above the keys of the keyboard of the typewriter to which the attachment is to be put on. There are as many of these apertures as the number of keys of the keyboard to be manipulated, said apertures accommodate slidably in a free manner a corresponding number of preferably cylindrical rods 21, 22, 23, and 24, defined as push-rods. It is to be noticed that 11, 12, 13, and 14 are to be repeated from ten to twelve times in an attachment to a normal typewriter, on four lines which are essentially rectilinear and parallel to the lines of characters appearing on the paper attached to the carriage of the typewriter in a normal typing session. For the intelligence of the description, these parallel lines of apertures and their corresponding lines of push-rods are referred to from now on as rows of apertures 11, 12, 13, and 14, and rows of push-rods 21, 22, 23, and 24. Owing to the standards generally adopted in typewriter manufacturing at the present time, the distances between the apertures and between push-rods in a row are essentially the same for each typewriter, and vary slightly around $\frac{3}{4}$ of an inch. In one embodiment of this invention, the apertures 11, 12, 13, and 14 have the same diameter, which is slightly larger than the diameter adopted for all the push-rods 21, 22, 23, and 24 which have a nominal diameter of 3/16". The length of the push-rods, however, is only the same for the same row, and varies from one row to another for the purpose of accommodating the staircase arrangement of the rows of keys of said keyboard, in a manner such that, while each rod bears directly on its lower tip on each key of the typewriter, its upper tip is essentially at the same horizontal level as all the upper tips of the other push-rods. This horizontal level is at a suitable distance above the upper surface of plate 10, said distance being preferably $\frac{1}{4}$" for an attachment to an electric typewriter.

Slidably moving back and forth in a direction orthogonal to rows of apertures 11, 12, 13, and 14, and parallel to plate 10 and positioned about $\frac{5}{8}$" above plate 10 is a plurality of flat, rectangular stips 40 of about 1/16" of thickness, made of firm, low-friction, low-wear material, each having essentially circular apertures 41, 42, 43, and 44. These strips will be referred to as selecting elements. Under the influence of pull solenoid 45, spring 46, and guide 82, apertures 41, 42, 43, and 44 of each selecting element 40 can be made to move back and forth in a rectilinear translation in a direction orthogonal to the rows 11, 12, 13 and 14 of apertures of plate 10. The pattern of locations of apertures 41, 42, 43, and 44 on each selecting element 40 can be seen in FIG. 2. FIG. 5 shows twelve of these selecting elements 40, with their apertures 41, 42, 43, and 44 positioned above their corresponding push-rods and keys of the keyboard of a typewriter of the American Electric Standard type. It can be seen in this FIG. 5 that one of these selecting elements 40 has only one of its apertures, aperture 41, correspond to one of the keys of the keyboard, and another selecting element next to said first one has three of its apertures, apertures 41, 42, and 43, correspond to three keys of the keyboard; while all the remaining selecting elements have each its four apertures correspond to four keys of the keyboard. The pattern of locations of apertures of all selecting elements follows that which would correspond to the keys of said keyboard that would occupy the positions of the keys intended for the printing of characters "6," "t," "g," and "v" on said typewriter keyboard. As can be seen in FIG. 1, the amplitude of the linear translational movement of selecting elements 40 is limited by means for limiting stops 48 and 49. Washers 49 secured on the plunger of each solenoid 45, limit said movement of the selecting elements to the left; while L-shape channel 48 limits said movement to the right. Always referring to FIG. 1, the left limiting position of the selecting elements will be referred to as the operative position, and the right limiting position of said selecting elements will be referred to as the inoperative position of said selecting elements. In the rest of this specification, the description of the operation of the invention is done as if each selecting element had all of its four apertures 41, 42, 43, and 44 correspond to four keys of the keyboard. It will be obvious that such description would cover all other selecting elements with lesser number of apertures involved in the operation.

Slidable in reciprocal movements through apertures 41, 42, 43, and 44 of selecting elements 40 are sticks 51, 52, 53, and 54, referred to as push-sticks. Each push-stick, preferably, is formed with steel wire of about 16 gauge into a loop of inside diameter about 130 mils at one end, and into a straight line at the rest of the stick. Details of such an embodiment of push-sticks can be seen in FIG. 4*a*. In the attachment for said electric typewriter, twelve push-sticks 51 are linked through their loops to the elongated, rectilinear part of about $\frac{1}{8}''$ in diameter, of a bar 61, which is also referred to as push-bar 61, constructed as depicted in FIG. 3. Spacers 66, mounted between loops of said push-sticks, serve as means for maintaining the points of rotatable linkage between push-sticks and push-bars well located and stabilized on each push-bar. Thus, referring to FIG. 1, and repeating push-sticks 51 twelve times on push-bar 61, it can be seen that all the loops of push-sticks 51 rotate on the same axis, are essentially parallel to themselves, and are orthogonal to that part of push-bar 61 going through them. Similarly, eleven push-sticks 52 are rotatably linked to push-bar 62; eleven push-sticks 53 are rotatably linked to push-bar 63; and ten push-sticks 54 are rotatably linked to push-bar 64. To be understood is that each push-rod in rows 21, 22, 23, and 24 has one corresponding push-stick positioned above it as seen in FIG. 1.

Push-bar 61 is designed and mounted to be moved on command with proper strength and duration by an electrical pulse via solenoid 65 of a pull type, in a manner as to drive the axis of all the loops of push-sticks 51 rotating around it through an arc which is of small circular angle; said arc being assimilable practically with a rectilinear excursion of about $\frac{1}{4}''$, in a direction vertical and going through the axes of all the push-rods 21. In the preferred embodiment, this latter direction can be seen as orthogonal to the direction of movement of the selecting elements and to the direction of the elongated, rectilinear part of push-bar 61. One way of implementing means for moving push-bar 61 in the described manner is to use a solenoid 65 of the pull type, a spring, and simple linkages well known in the art, as shown in FIG. 3. Means for limiting the movement of the plunger of the solenoid 65, and consequently the movement of the push-bar 61, between two extreme positions, can be arranged as for the solenoids 45 and selecting elements 40. These two positions for push-bar 61, referring to FIG. 1, are: the highest, referred to also as the inoperative position, and the lowest, referred to also as the operative position of push-bar 61. When push-bar 61 is moved from inoperative position to operative position, one of two situations would happen: either the lower tip of one of the push-sticks 51 would go down vertically and bear on the circular area of the upper tip of one of the push-rods 21 corresponding to that push-stick and push that push-rod down a distance of about 3/16", or else, would go through a zone beyond the area of the upper tip of said particular push-rod 21, and thus would have no effect on said push-rod 21. One of these situations, made mutually exclusive, would happen depending whether the particular selecting element 40 through aperture 41 thereof slides push-stick 51 was moved to operative position or not at that particular moment. If said particular selecting element was moved to operative position, it would be pulled to the left in FIG. 1, and the translational action of aperture 41 would cause the straight stick of push-stick 51 to be in a direction practically vertical that would go through the center of the upper tip surface of said push-rod 21, and action on said push-rod would take place, and the corresponding key of said push-rod would be caused to move down about 3/16" and held at that position long enough to cause the character corresponding to said key to be printed on the paper attached to the carriage of said typewriter. In the contrary, if said particular selecting element 40 was in the inoperative position at that particular moment, there would be no action on push-rod 21. Similar situations apply to push-rods 22, 23, and 24, corresponding push-sticks 52, 53, and 54, corresponding apertures 42, 43, and 44 of selecting elements, corresponding keys of the keyboard and push-bars 62, 63 and 64.

In the operation of the invention, each time a character is to be printed, a code, e.g. one of the 128 possible 7-bit codes of ASCII, corresponding to that character is sent to the electronics of the attachment. This electronics decodes and translates this code uniquely into one electrical pulse of proper strength and duration for one and only one of the twelve solenoids 45, and another electrical pulse of proper strength, duration and delay with respect to the first pulse, for one and only one of the four solenoids 65. It can be seen then, one and only one character coresponding to the combined effects of one particular selecting element 40 and of one particular push-bar 61, 62, 63 or 64, would be printed. The electronics of the attachment also issues an electrical pulse of proper strength, duration and a proper time ahead of the aforementioned pulses to cause the typewriter to shift up, shift down, stay up or stay down, by means of proper solenoids and linkages, in order to take care of the dual-character keys of the keyboard.

As an extra part of this invention is the actuation of the class of keys characterized by "Shift," "Space," "Tab," "Carriage Return," and "Back Space," which can be done more efficiently with solenoids dedicated to these functions, along with simple levers, linkages, and push-rods positioned correspondingly on the keys related to those functions.

In this invention, as applied to a standard electric typewriter, eighty-eight characters can be manipulated remotely with only eighteen relatively small solenoids and their driving circuits. (Two solenoids are used in tandem for the shift-up and shift-down function to simplify the driving circuits). This amount of hardware is relatively small compared to that required by the brute-force, one-solenoid-per-key, approach that would utilized forty-six solenoids of the same size as in this invention, with their forty-six driving circuits. This economy in hardware, and in cost, is realized whenever the invention is applicable to a keyboard of great number of keys. The greater the number of keys, the greater the economy realized, compared to said brute-force approach. The electronics can be made as sophisticated as necessary for parallel or serial communications with a remote station sending the codes, and can be implemented with state-of-the-art electronic components.

Each aperture of the selecting elements is such that it is large enough as to allow a large push-stick to slide in and out thereof but small enough as to ensure the suitable rigidity and durability of each selecting element and at the same time such that the movement of each selecting element between inoperative and operative positions does not create by friction the same movement in any of the other selecting elements.

Concavity which will enhance the reliability of the operation of the invention, and convexity for low-marring effect on keys of the keyboard can be machined into the upper and lower tips of the push-rods as shown in sectional view of FIG. 1.

FIG. 4(*a*), 4(*b*), and 4(*c*) show three slightly varied forms of implementing means for rotatably linking the push-sticks to the push-bars. In all these forms, said elongated part of a push-bar is cylindrical and about $\frac{1}{8}''$ in diameter. In FIG. 4(*a*), a push-stick is formed with steel wire of about 1/16" in diameter into a loop of about 130 mils of inside diameter at one end, and into a straight stick at the rest of the push-stick. In FIG. 4(*b*), a push-stick is composed of a piece of low-friction, low-wear material having an aperture of inside diameter of about 130 mils and having attached thereto a straight stick of steel of about 1/16" of diameter. In FIG. 4(*c*), a push-stick is formed in one piece, with a loop of inside diameter of about 130 mils at one end and a straight stick at the remainder. Such a push-stick can be made of low-friction, low-wear materials by many processes well known in the art. In all three said forms of implementing means for rotatably linking the push-sticks to the push-bars, spacing means, similar to spacers 66 in FIG. 3, is to be used to maintain the points of rotatable linkage between push-sticks and push-bars well located and stabilized on each push-bar.

FIG. 4(*e*) and 4(*g*) show another form of implementing said rotatable linkage. In this form, the elongated part of each push-bar is made of a straight strip of firm material such as steel of proper thickness. Secured parallely to this strip by any means is another strip of similar material and similar dimensions having such apertures and such forming as to constitute with the first strip properly located, elongated rotatable bearings for push-sticks depicted in FIG. 4(*f*); said push-sticks being made as L-shaped sticks of firm material, preferably steel, of circular section of about 1/16". It is seen readily that spacing between push-sticks on the same push-bar is inherently built in here. The four forms of rotatable linkage just described are equally good in situations where the invention is applied to a keyboard in which the keys are readily groupable in rows and columns, one of said rows crossing one of said columns at an angle of ninety degrees. These four forms of rotatable linkage, however, will cause difficulties in the operation of the invention if said angle deviates appreciably from ninety degrees. In the most general cases, this angle not only would deviate appreciably from ninety degrees, it could vary from one crossing to another. The form of rotatable linkage depicted in FIG. 4(*d*) would make the operation of the invention possible in these most general cases. In this form, the elongated part of a push-bar is made similarly to the linkage depicted in FIG. 4(*e*) and 4(*g*), in a manner as to form rotatable ball-and-socket joints with the globules at one end of the push-sticks; each globule being of a diameter suitably greater than that of the rest of the push-stick, preferably made with a straight piece of steel wire of about 16 gauge. This last ball-and-socket form of rotatable linkage not only allows each push-stick in this case to rotate freely through a suitable angle in a plane as a push-stick in one of the aforementioned forms of linkage, it allows readily each push-stick to rotate freely through a suitable solid angle in space around the point of linkage. It can be seen also that spacing between push-sticks on the same push-bar is built in here, too. It can be thus appreciated that this last form of rotatable linkage allows the invention to be applicable to all the practical keyboards having a great number of keys arranged in any reasonably coordinated manner.

When applied specifically to the keyboard of a typewriter, the operation of the invention can be improved with some extra parts that contribute to the strengthening of the attachment which characterizes the invention, and that allow the attachment to be quickly and easily put on, or removed from said typewriter. Such parts can be seen in FIG. 1 as a base 70 on which said typewriter is positioned and secured with fastening means that does not allow the removal of said typewriter therefrom unintentionally; two side walls 80 secured to plate 10 and supporting it a suitable distance from base 70, when said side walls are put to rest on said base in their operational position; a square-section channel 84 secured at each of its ends to one of said side walls; and finally limiters 83 secured on plate 10 along the rows of push-rods and protrusion 21*a*, as seen in FIG. 6, formed in the upper tips of all the push-rods, serving the purpose of limiting the movement of the push-rods between an upper position, also referred to as inoperative position, and a lower position, also referred to as operative position of the push-rods. Limiters 83 ensure the reliable operation of the invention when the combination attachment and typewriter is in such position as to orient the push-rods on a non upright and vertical direction, by preventing the push-rods from going in the direction from plate 10 to selecting elements 40 so far as to render the operation of the push-sticks difficult or impossible. Protrusion 21*a* on the upper tips of the push-rods prevents the push-rods from falling out of plate 10 when the attachment is removed from the typewriter. The attachment can further have a cover for protection from dust and for decoration purpose, and can be managed to have room for the necessary electronics and power supplies.

The whole attachment for a typewriter which is secured on a base in the manner described, can be put into the operational position on said typewriter by proper means for repeatably positioning the undersides of said side walls on the upper surface of said base, and fastening them thereto, in such a manner as to align the lower tips of all the push-rods on top of the correspondent keys of the keyboard. As the tops of said keys move along with the lower tips of the corresponding push-rods between two positions, the upper and lower positions of the keys are also referred to as the inoperative and operative positions of the keys, respectively, in the general assumption that, on the keyboard of a standard typewriter, said lower position of the keys is the one that actuates the functions intended for said keys.

The invention having been described, it is to be understood that the different dimensions and forms of implementation set forth in this specification are for better visualization of the disclosure, are capable of further modification and variations, and should not be construed as to limit the scope of the invention, which is limited only by the appended claims.

What I claim is:

1. An attachment for remote control of a keyboard comprising:

a. a series of selecting elements mounted for movement in a first direction between inoperative and operative positions b. each of said selecting elements having a series of apertures c. a series of push-bars mounted for movement in a second direction d. each of said push-bars comprising an elongated member oriented longitudinally in a third direction e. a plurality of push-sticks f. each of said push-sticks having linkage at one of its ends rotatably connected to one of said elongated members of said push-bars and linkage at its other end slidably confined in one of said apertures of one of side selecting elements g. means for selectively moving said selecting elements and said push-bars h. a plurality of push-rods mounted for movement between inoperative and operative positions in a fourth direction preferably parallel to said second direction.

i. each of said push-rods being positioned near a corresponding aperture of one of said selecting elements, corresponding push-stick and a corresponding key of said keyboard j. each individual push-rod having means for linking a first one of its surfaces to a particular surface of said corresponding key and causing said key to move in a fifth direction preferably parallel to said fourth direction from inoperative position to operative position when said individual push-rod is moved from inoperative position to operative position respectively k. said individual push-rod having a second surface opposite to said first surface acted upon by said slidable end of said corresponding push-stick in the direction that causes in turn said corresponding key to move in the direction from inoperative position to operative position only when the selecting element slidably linked to said corresponding push-stick was first selectively moved to operative position and then the push-bar rotatably linked to said corresponding push-stick was next selectively moved to operative position.

1. whereby selectively moving said selecting elements and said push-bars selectively moves said keys of said keyboard from inoperative position to operative position and actuates consequently the functions intended for said keys.

2. An attachment for remote control of a keyboard as defined in claim 1 wherein:

a. in the operative position of a selecting element the center of each aperture of said selecting elements and the point of rotatable linkage of the corresponding push-stick with a push-bar lie essentially on a line parallel to said second direction and passing by the center of said particular surface of the corresponding key of said keyboard, b. said particular surface of the corresponding key of said keyboard is the surface originally designed for finger manipulation of said key, and c. each aperture of said selecting elements is such that it is large enough as to allow a large push-stick to slide in and out thereof but small enough as to ensure the suitable rigidity and durability of each selecting element and at the same time such that the movement of each selecting element between inoperative and operative positions does not create by friction the same movement in any of the other selecting elements.

3. An attachment for remote control of a keyboard as defined in claim 2 wherein:

a. there exists a plate of such material and dimensions as to permit slidable mounting of said push-rods in said fourth direction, mounting of said push-bars for movement in said second direction, mounting of said selecting elements in said first direction, mounting of means for moving said push-bars and said selecting elements and of means for said attachment to be quickly put on or removed from said keyboard.

4. An attachment for remote control of a keyboard as defined in claim 3 wherein:

a. the length of said push-rods are such that said second surfaces of push-rods are a same suitable distance from the plane that generally passes by the tips of said push-sticks near said slidable linkage of said push-sticks.

5. An attachment for remote control of a keyboard as defined in claim 4 wherein:

a. said push-rods are of cylindrical shape, b. suitable concavity is formed in said second surface of said push-rods, and c. suitable convexity is formed in said first surface of said push-rods.

6. An attachment for remote control of a keyboard as defined in claim 5 wherein:

a. there exists means for limiting the movement of said push-rods between said inoperative and operative positions even when said attachment is positioned in different orientations or removed from said keyboard.

7. An attachment for remote control of a keyboard as defined in claim 6 wherein:

a. there exists means for maintaining the points of rotatable linkage between push-sticks and push-bars well located and stabilized on each push-bar.

8. An attachment for remote control of the keyboard of a typewriter as defined in claim 7 wherein:

a. said elongated part of said push-bars is rectilinear, b. said second coordinated direction follows the path of an arc of small circular angle, said arc being assimilable practically with a rectilinear direction preferably orthogonal to said first and third directions, and c. said keys of said keyboard are the majority of keys of the keyboard of said typewriter.

9. An attachment for remote control of the keyboard of a typewriter as defined in claim 8 wherein:

a. said first and third directions are made to be essentially orthogonal to each other, b. all said selecting elements have the same pattern of locations of apertures, and c. one of said selecting elements have its apertures correspond to the keys of said keyboard that would occupy the positions of the keys intended for the printing of characters "6," "t," "g," and "v" on a typewriter keyboard.

10. An attachment for remote control of the keyboard of a typewriter as defined in claim 9 wherein:

a. said mounting means for said attachment to be quickly put on or removed from said keyboard comprises a base thereon said typewriter is positioned and secured with fastening means that does not allow the removal of said typewriter therefrom unintentionally, two sidewalls secured to said plate and supporting it a suitable distance from said base when said side walls are removably secured in their operational position on said base and further means for securing said side walls in their intended positions on said attachment.

11. An attachment for remote control of the keyboard of a typewriter as defined in claim 10 wherein:

a. means for selectively moving said selecting elements and said push-bars comprises solenoid means, spring means, mechanical linkage means.

12. An attachment for remote control of the keyboard of a typewriter as defined in claim 11 wherein:

a. there exists further means for actuating the extra keys not already included in said keyboard.

13. An attachment for remote control of the keyboard of a typewriter as defined in claim 12 wherein:

a. each of said push-sticks is made of suitable material with a circular aperture at one end and a straight stick of proper size at the remainder of said push-stick, and b. said elongated part of each of said push-bars comprises a cylindrical bar of proper material and of a diameter such as to allow said cylindrical bar to rotate freely in said circular aperture at one end of said push-sticks.

14. An attachment for remote control of the keyboard of a typewriter as defined in claim 12 wherein:

a. each of said push-sticks is made of suitable material into an L-shaped stick of proper size, and b. said elongated part of each of said push-bars is made of a strip of suitable material and secured parallely by adequate means to another similar strip having such apertures and forming as to constitute with said first strip properly located elongated rotatable bearings for push-sticks essentially made as in part (a) of this claim.

15. An attachment for remote control of the keyboard of a typewriter as defined in claim 12 wherein:

a. each of said push-sticks is made of suitable material into a globule of proper size at one end and a straight stick of proper size at the remainder of said push-stick, and b. said elongated part of each push-bar is made of a strip of suitable material and secured parallely by adequate means to another similar strip having such apertures and forming as to constitute with said first strip properly located rotatable sockets for ball-and-socket joints with said globules of push-sticks essentially made as in part (a) of this claim.

* * * * *